US008713843B2

(12) United States Patent
Windauer

(10) Patent No.: US 8,713,843 B2
(45) Date of Patent: May 6, 2014

(54) OPERATOR-PROGRAMMABLE-TRAJECTORY TURRET KNOB

(75) Inventor: Bernard T. Windauer, Kalispell, MT (US)

(73) Assignee: Bernard T. Windauer, Kalispell, MT (US)

( * ) Notice: Subject to any disclaimer, the term of this patent is extended or adjusted under 35 U.S.C. 154(b) by 0 days.

(21) Appl. No.: 13/351,457

(22) Filed: Jan. 17, 2012

(65) Prior Publication Data

US 2012/0186131 A1 Jul. 26, 2012

Related U.S. Application Data

(60) Provisional application No. 61/433,244, filed on Jan. 16, 2011.

(51) Int. Cl.
*F41G 3/08* (2006.01)

(52) U.S. Cl.
USPC ..... 42/113; 235/404

(58) Field of Classification Search
USPC ..... 42/111, 113, 119, 120, 122, 123, 130, 42/131, 132, 125; 359/813, 821; 356/247; 235/404
See application file for complete search history.

(56) References Cited

U.S. PATENT DOCUMENTS

| | | | | |
|---|---|---|---|---|
| 1,107,163 | A | 8/1914 | Grauheding | |
| 1,127,230 | A | 2/1915 | Grauheding | |
| 3,682,552 | A | 8/1972 | Hartman | |
| 3,948,587 | A | 4/1976 | Rubbert | |
| 5,491,546 | A | 2/1996 | Wascher et al. | |
| 6,196,455 | B1 | 3/2001 | Robinson | |
| 7,958,665 | B2 | 6/2011 | Hamilton | |
| 2008/0202198 | A1 | 8/2008 | Davidson | |
| 2009/0241399 | A1 | 10/2009 | Hamilton | |
| 2009/0266892 | A1 * | 10/2009 | Windauer et al. | 235/404 |
| 2010/0175298 | A1 | 7/2010 | Thomas et al. | |
| 2011/0030264 | A1 | 2/2011 | Davidson et al. | |
| 2011/0047854 | A1 | 3/2011 | Schlierbach | |
| 2011/0061285 | A1 | 3/2011 | Hamilton | |
| 2011/0271577 | A1 | 11/2011 | Davidson | |

* cited by examiner

*Primary Examiner* — Samir Abdosh
*Assistant Examiner* — John D Cooper

(57) ABSTRACT

An adjustment turret knob for a telescopic sight comprises a programmable function in which rotational positions of the knob for a specific projectile, at selected ranges, ambient atmospheric conditions, or field conditions, or any combination thereof, are stored and later used for adjusting elevation or windage settings based on the determined range of a target or conditions experienced in the field. In one exemplary embodiment, the turret knob is capable of determining, or calculating, a "best fit" trajectory curve for a specific projectile based on the stored rotational positions of the turret knob relating to the conditions under which the projectile was fired and conditions stored in memory.

15 Claims, 6 Drawing Sheets

OPERATOR-PROGRAMMABLE-TRAJECTORY TURRET KNOB

The present patent application claims priority to U.S. Provisional Patent Application Ser. No. 61/433,244, entitled "Operator-Programmable-Trajectory Turret Knob," filed Jan. 16, 2011, and invented by Bernard T. Windauer, the disclosure of which is incorporated by reference herein.

BACKGROUND

The subject matter disclosed herein relates to an optical enhancing device, such as a telescopic observation sighting device or individual shoulder (or hand-fired) firearms sighting device (telescopic sight herein). Embodiments according to the subject matter disclosed herein may also be used with any optical enhancing device containing adjusters, such as a microscope, telescope, etc. For purposes of illustration, it will be assumed herein that the optical enhancing device is a telescopic firearms sight.

A telescopic sight, typically used to aim a firearm, is usually mounted on the firearm. An adjustment knob on a telescopic sight is typically used for changing a setting of an adjuster, for example, elevation, crossrange (also referred to as windage herein), or parallax, of the telescopic sight. Parameters such as elevation, crossrange, and parallax, may be painstakingly set in order that the projectile fired from the firearm hit a specific target at the intended point of impact (POI). Once set for a particular projectile/ambient condition/distance combination, the adjustment setting preferably remains unchanged unless ambient conditions or the distance changes or until after a shot is fired at the target, whereas the adjustments may be changed for another set of conditions.

Existing telescopic sighting systems for civilian, law enforcement, and military firearms typically utilize three types of adjustment knobs. The first type of adjustment knob has a cover cap that must be removed to make a sight setting adjustment. The second type of adjustment knob has no cover cap and is permanently exposed and allowed to rotate freely. The third type of knob is a locking knob in which the lock must be released prior making an adjustment.

Around the circumference or at the base of all three types of knobs are numerals and index marks to indicate the rotational setting of the knob with respect to a fixed datum mark. To adjust the knob of the telescopic sight so that the projectile impacts the target requires an operator to make multiple practice shots and become intimately familiar with the specific projectile trajectory profile under various ambient conditions and distance combinations. During the intended use, whether it is hunting, competition, military use, or police tactical use, the operator must visually check the reference marks against the datum mark and modify the adjustments based on the knowledge gained through practice at the same or similar distance and ambient conditions such that the bullet point of impact is at the desired place on the target. It is almost impossible for the operator to be intimately familiar with the projectile trajectory for the infinite number of bullet, velocity, distance, slope, temperature, and weather condition combinations that exist in the field. Under these conditions, the operator must make a "best guess" and make adjustments accordingly. Presently all adjustment values are gauged from the reference marks and datum marks for each adjustment knob. In some circumstances, such as military or tactical applications in which the telescopic sight is used in the dark, the operator cannot visually check the external telescopic sight setting scale, which necessitates some sort of internal scale that is possibly illuminated.

BRIEF DESCRIPTION OF THE DRAWINGS

The subject matter disclosed herein is illustrated by way of example and not by limitation in the accompanying figures in which like reference numerals indicate similar elements and in which.

DETAILED DESCRIPTION

Figure 1:
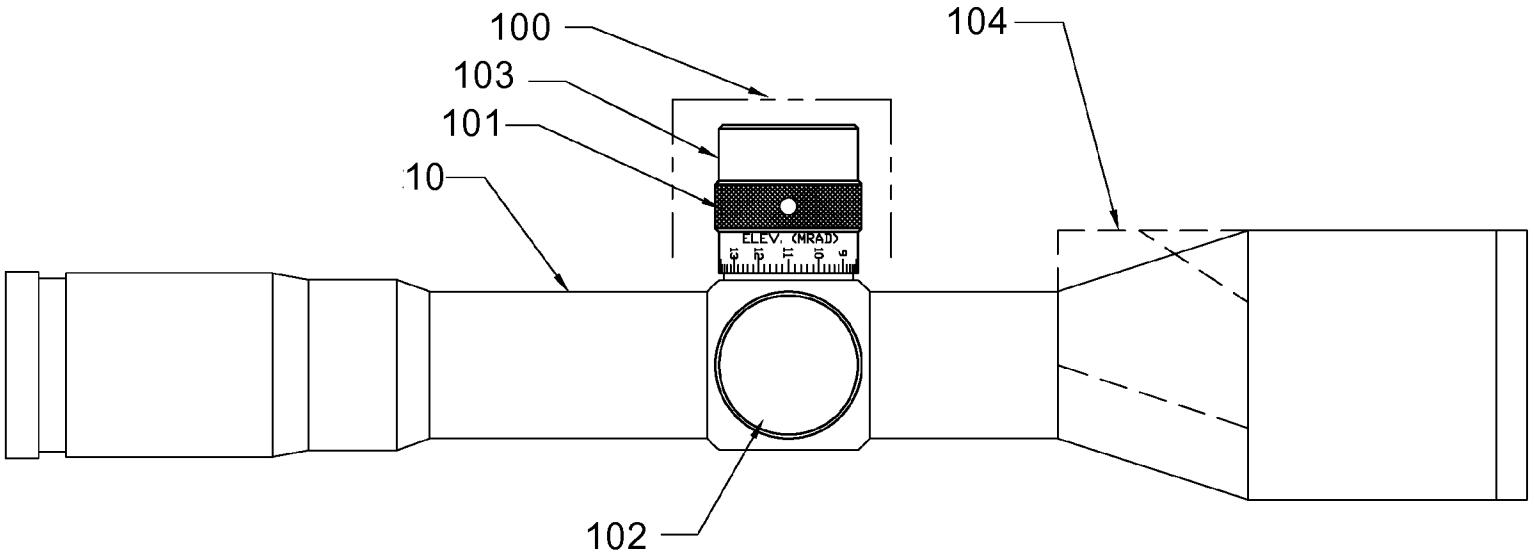
FIG. 1 depicts a right side view a first exemplary embodiment of an Operator Programmable Trajectory Turret Knob (OPTTK) according to the subject matter disclosed herein.

The word "exemplary" is used herein to mean "serving as an example, instance, or illustration." Any embodiment described herein as "exemplary" is not to be construed as necessarily preferred or advantageous over other embodiments. Additionally, as used herein, the terms "user," "shooter" and "operator" are interchangeable; the terms "crossrange" and "windage" are interchangeable; and the terms "distance" and "range" are interchangeable.

The subject matter disclosed herein relates to an adjustment turret knob for a telescopic sight comprising a programmable function in which rotational positions of the knob for a specific projectile, at selected ranges, ambient atmospheric conditions, or field conditions, or any combination thereof, are stored and later used for adjusting elevation or windage settings based on the determined range of a target or conditions experienced in the field. In one exemplary embodiment, the subject matter disclosed herein has the ability to determine, or calculate the "best fit," a trajectory curve for a specific projectile based on the stored rotational positions of the turret knob relating to the conditions under which the projectile was fired and conditions stored in memory. In another exemplary embodiment, the subject matter disclosed herein has the ability to store values relating to the cartridge, projectile type, characteristics, and velocity, and condition parameters, such as, but not limited to, distance (or range), slope (or inclination), temperature, altitude, location, direction, and ambient weather conditions under which a projectile is fired. In another exemplary embodiment, the subject matter disclosed herein has the ability to output to a remotely located device values relating to cartridge, projectile type, characteristics, and velocity, and the condition parameters, such as, but not limited to, distance (or range), slope (or inclination), temperature, altitude, location, direction, and ambient weather conditions under which a projectile is fired. In another exemplary embodiment, the subject matter disclosed herein comprises the ability to accept from a remotely located device values relating to the adjustment knob rotational positions or a pre-calculated trajectory curve for a specific cartridge(s), projectile type, characteristics, and velocity, and condition parameters, such as, but not limited to, distance (or range), slope (or inclination), temperature, altitude, location, direction, and ambient weather conditions under which the projectile(s) may be fired.

The subject matter disclosed herein provides an adjustment knob that has either a single or multiple functions that can be programmed and stored in memory by an operator when a specific single or multiple sight settings are desired for specific factory or custom loaded ammunition types.

The subject matter disclosed herein provides an adjustment knob for an optical setting, such as elevation, windage, parallax, or illuminated reticle power control for an optical-based instrument, such as a telescopic sighting system, a telescope, mono or binocular, or a microscope, that can be mechanically stopped at a single location or at multiple locations, thereby eliminating the need to view the numerical or linear index marks to indicate sight settings. Accordingly, one exemplary embodiment of the subject matter disclosed herein allows a user to program a memory associated with the adjustment knob to match one or several projectile trajectories, various field conditions, or any combination of both and read-out the information within the field of view, thereby permitting a desired adjustment of an optical or power setting without needing to visually observe the value of the adjustment on the outside of the adjustment mechanism during use. Thus, optical or power settings set by a user are reliably made repeatedly during use without the need for visual verification regardless of the environmental conditions.

In one exemplary embodiment, the subject matter disclosed herein allows an operator the ability to adjust a turret knob and stop at a numerical (rotational) setting that corresponds to a desired point of impact (POI) at a desired range. The subject matter disclosed herein allows an operator to set and store a bottom, or first, turret knob stop position, and set and store a finite number of positions in memory respectively corresponding to a trajectory of a projectile and/or conditions in the field where the projectile will be fired. Additionally, the operator can then initiate a processor to determine and store a trajectory curve that is based on the stored rotational values. Another exemplary embodiment of the subject matter disclosed herein allows an operator the ability to adjust a turret knob to stop at a numerical (rotational) setting corresponding to a desired point of impact (POI), or at a selected point on a determined calculated trajectory curve corresponding to a desired range. In one exemplary embodiment, an operator can set a "zero" location at the bottom end of scope adjustments, and then stop at any rotational position that corresponds to any field conditions that are encountered matching or closely matching rotational "stops" stored in memory. Further, in the event that there is an electronic system failure, a mechanical bottom "zero" setting, external rotational reference scales, a datum mark, and tactile indications of rotation permitting the subject matter disclosed herein to be used as a conventional sighting system.

Figure 2:
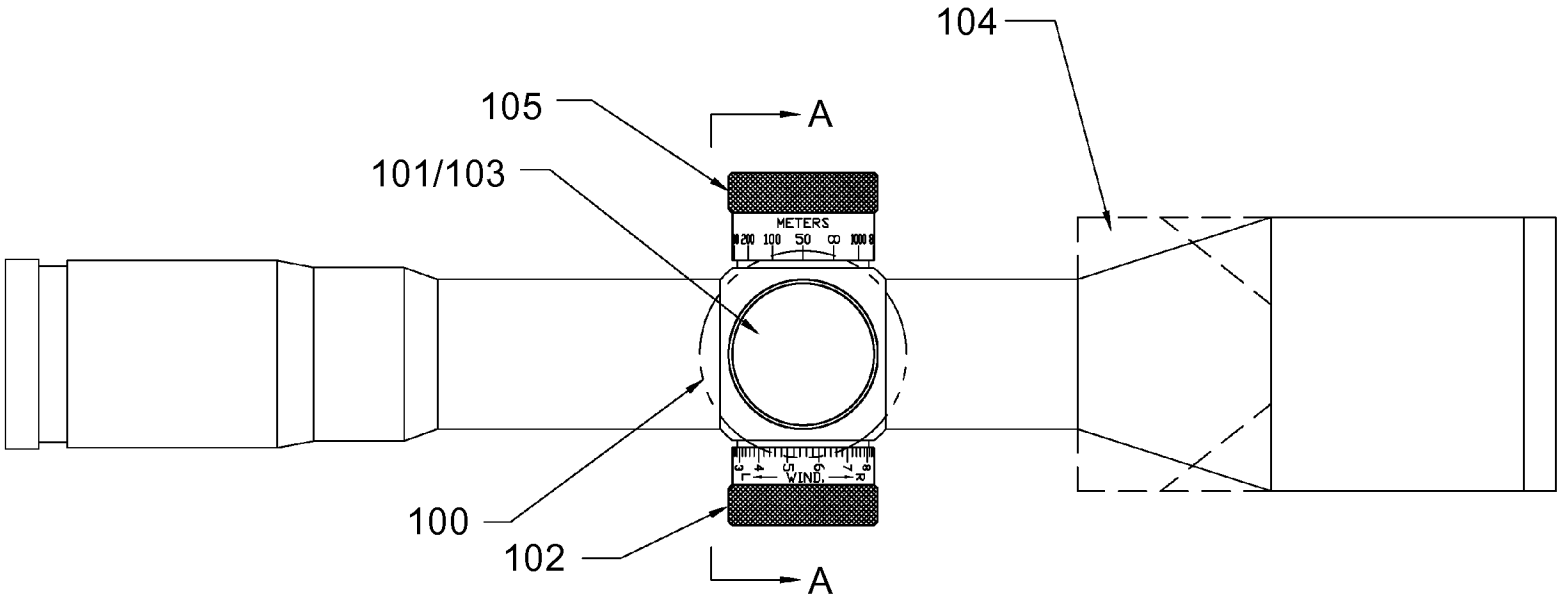
FIG. 2 depicts a top view of the first exemplary embodiment of an OPTTK according to the subject matter disclosed herein.
Figure 3:
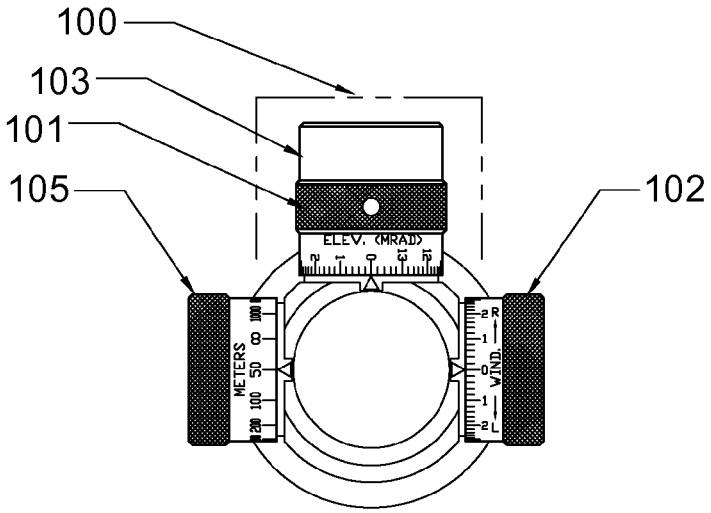
FIG. 3 depicts a cross-sectional view taken along line A-A in FIG. 2 of the first exemplary embodiment of an OPTTK according to the subject matter disclosed herein.

FIGS. 1 and 2 respectively depict a right side view and a top view of a first exemplary embodiment of an Operator Programmable Trajectory Turret Knob (OPTTK) 100 according to the subject matter disclosed herein. FIG. 3 depicts a cross-sectional view taken along line A-A in FIG. 2 of the first exemplary embodiment of an OPTTK 100 according to the subject matter disclosed herein.

As depicted in FIG. 1, OPTTK 100 comprises a turret knob section 101 and an electronic section 103. Electronics section 103 is generally located distal to a telescopic sight 10. Electronic section 103 houses or contains, but is not limited to, a rotational encoder, a processor, a memory, a battery, and programming buttons for programming information within electronics section 103 or in a remote location either on optical sight 10 or remotely located from the optical sight 10. OPTTK 100 can be used in conjunction with, a substitute for, or interfaced with, a conventional elevation adjustment knob 101, a windage adjustment knob 12, and a parallax adjustment knob 15. FIGS. 1 and 2 also depict one possible alternative location 104 in which selected components associated with electronics section 103 could be housed or contained.

Figure 4:
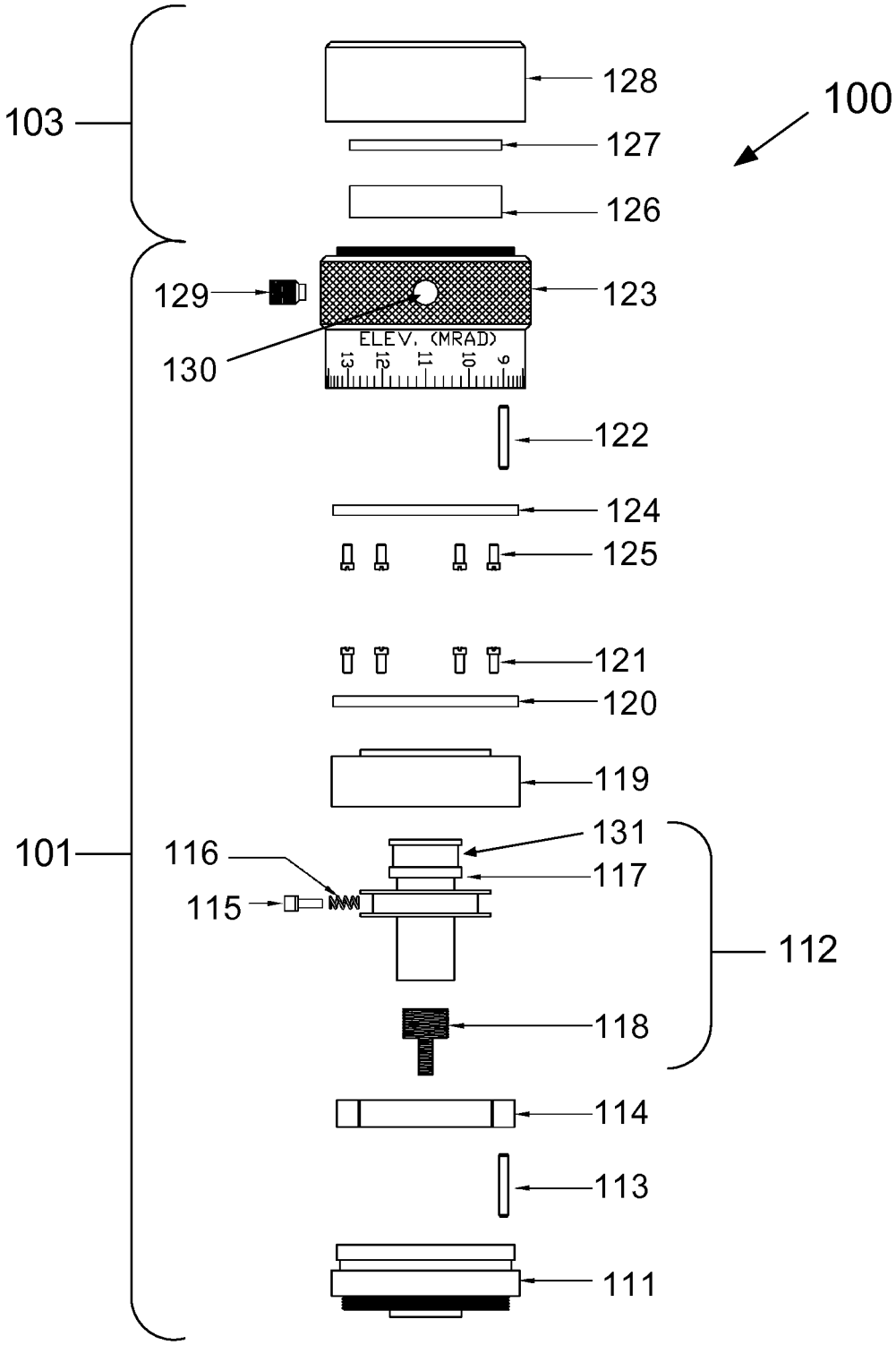
FIG. 4 depicts an exploded cross-sectional assembly view of the first exemplary embodiment of an OPTTK according to the subject matter disclosed herein.

FIG. 4 depicts an exploded cross-sectional assembly view of the first exemplary embodiment of OPTTK 100 according to the subject matter disclosed herein. As depicted in FIG. 4, the first exemplary embodiment of OPTTK 100 comprises a turret knob section 101 and an electronic section 103. Turret knob section 101 comprises a turret knob base 111, an adjustment spindle assembly 112, and a turret knob 123. Electronics section 103 comprises an electronic processor module 126 and battery, or power source, 127.

Turret knob base 111 is affixed in a fixed position to a scope body (not depicted in FIG. 4) in a well-known manner. A zero-stop pin 113 is inserted into a corresponding mating hole (not depicted) in turret knob base 111. A tactile ratchet gear 114 is installed on top of turret knob base 111 and aligned with the zero-stop pin 113. Tactile wedge (one or multiple depending on design) pins 115, of which only one is depicted, and one or multiple (depending on design) wedge springs 116, of which only one is depicted, are inserted into mating holes (not depicted) in adjustment spindle 117. Tactile wedge pin(s) 115 engage with splines (not depicted) formed internally to tactile ratchet gear 114 and provide a tactile indication in a well-known manner as OPTTK 100 is rotated. A spade screw 118 is screwed into mating threads (not depicted) in the bottom of adjustment spindle 117. The assembled adjustment spindle 112 is inserted through a mating hole (not depicted) in the turret knob base 111 and is held to turret knob base 111 in a well-known manner by gear-retainer cap 119, a fixed encoder disc 120, and four cap-retaining screws 121. Fixed encoder disc 120 comprises encoded information that is sensed in a well-known manner for determining an angular position of turret knob 123 with respect to fixed encoder disc 120.

A knob zero-stop pin 122 is inserted into a mating hole (not depicted) in a turret knob 123. An encoder sensor 124 is held to the interior of turret knob 123 by four retainer screws 125. An electronics processing module 126 is held in place on the top or an interior cavity (not depicted) of the turret knob 123 by retaining screws (not depicted), and is powered by a battery assembly 127 positioned above (or remotely located) electronics processing module 126. Electronics processing module 126 is in electrical communication with encoder sensor 124 in a well-known manner, such as by, but not limited to, electrical conductors between electronics processing module 126 and encoder sensor 124. A cover cap 128 is threaded or screwed on to turret knob 123. Knob set screws 129, of which only one is depicted, are threaded into mating holes 130, of which only one is depicted, in turret knob 123. Turret knob 123 is then mated to adjustment spindle assembly 112 through a hole (not depicted) respectively formed in turret knob 123, fixed encoder disk 120, and encoder sensor 124, and fixed in place by tightening knob set screws 129 against shoulder portion 131 of adjustment spindle 117.

Fixed encoder disc 120 and encoder sensor 124 can be configured as a mechanical rotary encoder or as an optical rotary encoder. In one exemplary embodiment, fixed encoder disc 120 and encoder sensor 124 operate in a well-known manner as an absolute-type rotary encoder. In another exemplary embodiment, fixed encoder disc 120 and encoder sensor 124 operate in a well-known manner as an incremental-type rotary encoder.

Figure 5:
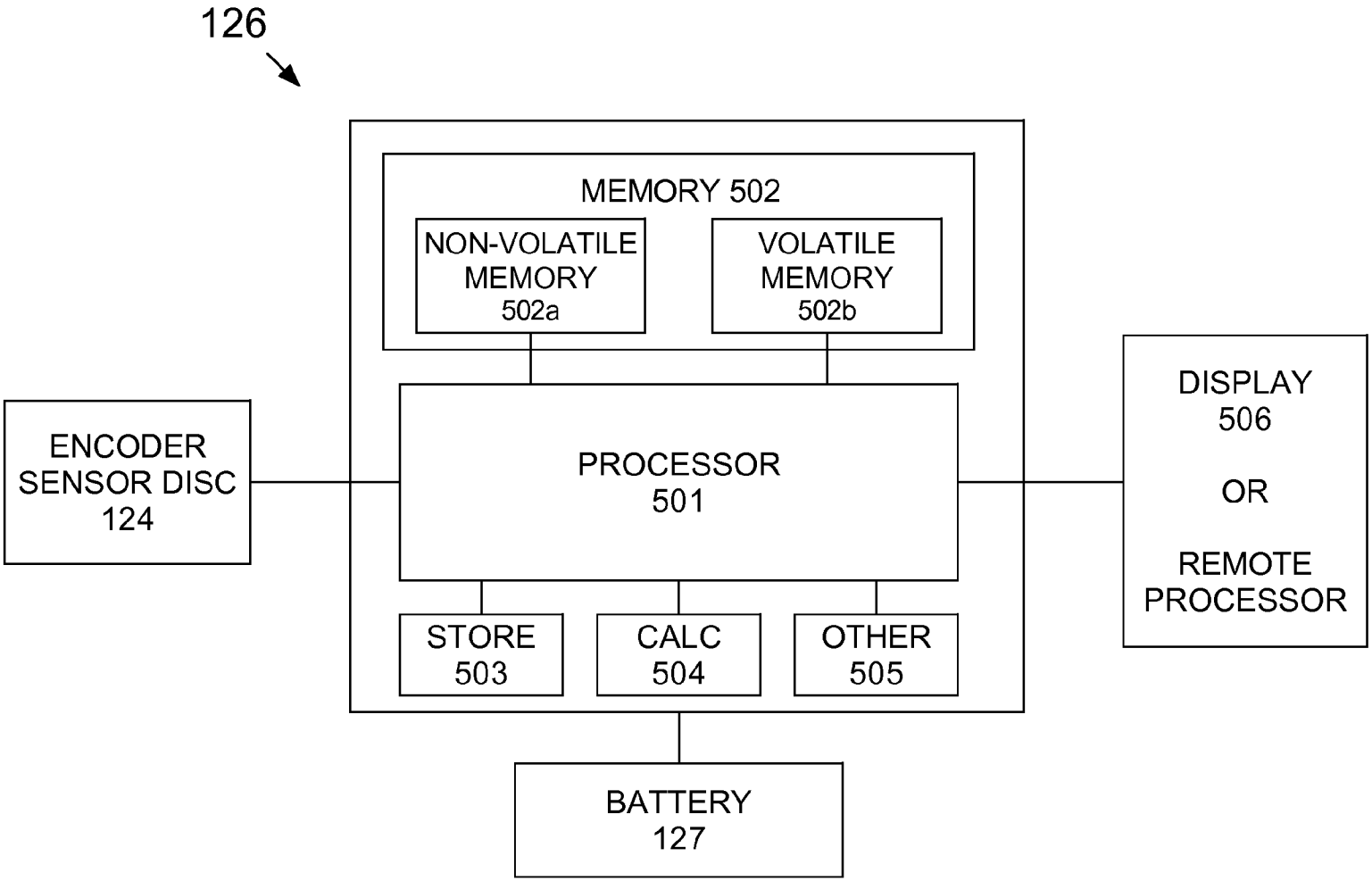
FIG. 5 depicts a functional block diagram of one exemplary embodiment of electronics processing module according to the subject matter disclosed herein

Electronics processing module 126 is configured to process the output signals from encoder sensor disc 124 that indicate a rotational position of turret knob 123 with respect to fixed encoder disc 120 and communicate to a user the sensed rotational position of turret knob 123. FIG. 5 depicts a functional block diagram of one exemplary embodiment of electronics processing module 126 according to the subject matter disclosed herein. As depicted in FIG. 5, electronics processing module 126 comprises, but is not limited to, a processor 501, a memory 502 and other peripheral components (not depicted) for communicating with encoder sensor 124 and for communicating angular position information that is displayed to a user. In one exemplary embodiment, memory 502 comprises a non-volatile memory portion 502*a* and a volatile memory portion 502*b*. In another exemplary embodiment, memory 502 comprises only non-volatile memory. In one exemplary embodiment, non-volatile memory 502*a* stores instructions executed by processor 501 and rotational position information so that the instructions and the rotational position information is not lost when power is turned off or lost.

Electronics processing module 126 is coupled to encoder sensor 124 and receives rotational position information sensed by encoder sensor 124. A Store button 503 and a Calculate button 504 are coupled to processor 501 in a well-known manner and provide a user interface for programming sensed rotational position information into memory 502 and for initiating determination of a trajectory corresponding to the stored rotational position information in memory 502. It should be understood that the subject matter disclosed herein is not limited to Store and Calculate buttons 503 and 504, but can include additional user interface devices corresponding to the functionality provided by electronics processing module 126. In yet another exemplary embodiment, electronic processing module 126 comprises additional interfaces 505 that can receive information either from a user or from peripheral components, such as a range finder, a temperature sensor, an inclinometer, an altimeter, etc. It should be understood that the various interfaces to and from electronic processing module 126 could be a wireless, i.e., a radio-frequency (RF) interface or an infrared interface.

Electronic processing module 126 also comprises an interface for outputting stored rotational position information for use by a display 506, such as, but not limited to, internal to a telescopic sight. Alternatively, electronics processing module 126 comprises an interface for outputting information to and receiving information from, but not limited to, a remotely located processing device having a greater computing power than processor 501. Battery 127 is coupled to and powers electronics processing module 126. In one exemplary embodiment encoder sensor 124 is powered through electronics processing module 126, which can execute an algorithm to reduce power consumption by encoder sensor 124. In another exemplary embodiment, encoder sensor disc can be power directly from battery 127.

In one exemplary embodiment, electronics processing module 126 comprises an application specific integrated circuit (ASIC) that provides the functionality. In another exemplary embodiment, electronics processing module 126 comprises one or more ASICs and/or one or more commercially available integrated circuits configured for providing the functionality.

OPTTK 100 is operated by shooting the firearm associated with OPTTK 100 at the closest distance (or range) desired. For example, suppose that the firearm is to be zeroed at a range of 100 meters. OPTTK 100 is rotated until the aiming point (i.e., intersection of the vertical and horizontal cross hairs indicated as 601 in FIG. 6) corresponds with the intended point of impact of the projectile on the target. This sight setting is termed the "zero" setting. Knob set screws 129 (FIG. 4) are then loosened to allow turret knob 123 to rotate around adjustment spindle 117 so that no internal movement of adjustment spindle 117 inadvertently occurs. While set screws 129 are loosened, turret knob 123 is rotated so that the zero numeral etched on the knob skirt aligns with the fixed datum mark (not depicted) on turret knob base 111. Knob set screws 129 are then tightened to fix, or lock, turret knob 123 to the adjustment spindle 117. At this distance and rotational setting, a Store button (button 503 in FIG. 5) is actuated, thereby storing the "zero" rotational setting into the memory of electronics processing module 126. That is, the sensed rotational code for the "zero" range is stored into the memory of electronics processing module 126. Accordingly, at this "zero" setting, the scope is set so that when the operator fires the firearm, the projectile impacts the desired location on the target at the first target range ("zero position"). In one exemplary embodiment, the Store button could be located on electronics processing module 126 and be accessible by removing cover cap 128. In one exemplary embodiment the "zero" range setting is stored in non-volatile memory portion 502*a* of electronics processing module 126.

To continue to the next setting to be programmed, the operator shoots the firearm at the second desired range, such as 200 meters. OPTTK 100 is rotated until the internal aiming point 503 corresponds with the intended projectile point of impact (POI) at the target. At this distance and OPTTK rotational setting, a Store button (button 503 in FIG. 5) is actuated, thereby storing the rotational setting OPTTK into a non-volatile portion of memory of electronics processing module 126. This procedure is repeated for each desired range or distance interval. When all desired rotational settings have been stored, a "Calculate" button (button 504 in FIG. 5) is actuated. In one exemplary embodiment, the Calculate button could be located on electronics processing module 126 and be accessible by removing cover cap 128. In response to actuation of the Calculate button, the processor of electronics processor module 126 determines and stores a trajectory curve, or profile, corresponding to the stored rotational position settings of the OPTTK and the projectile that was used. In one exemplary embodiment, the determined trajectory profile could be a piecewise-linear trajectory. In another exemplary embodiment, the determined trajectory profile could be based on a solution of a series of polynomial equations calculated in a well-known manner.

In another exemplary embodiment, additional information is stored with the rotational position settings of the OPTTK. For example, additional information is stored relating to the conditions for each stored rotational position setting, such as, but not limited to, cartridge, projectile type, projectile velocity, distance (or range), slope (or inclination), temperature, altitude, and ambient weather conditions, under which a projectile is fired. The trajectory profile is then calculated, or determined, based on stored rotational position settings and the additional information.

In yet another exemplary embodiment, an OPTTK provides the capability of sensing and storing rotational position information for a number of different projectiles. In an alternative exemplary embodiment, an OPTTK provides the capability to receive and store a trajectory profile for each desired projectile that has been calculated, or determined, by a remotely located processor based on rotational position information (and additional information) sensed by the OPTTK or OPTTK characteristics input into, and used by the remotely located processor to calculate the trajectory curve to be downloaded into the OPTTK. The calculated, or determined, trajectory profiles can be calculated from any of the commercially available ballistic software programs. Alternatively, a trajectory profile could be calculated, or determined, by an algorithm written specifically for an OPTTK.

In one exemplary embodiment, the OPTTK can be programmed for a number of different projectiles that the operator expects to use. For this exemplary embodiment, a primary (or fundamental) projectile is selected by the operator, and the OPTTK and firearm are zeroed as previously described based on the selected primary projectile. For this exemplary embodiment, a "Trajectory Select" button (not depicted) is actuated to select and identify each different trajectory. The operator then zeroes as previously described based on the selected primary projectile. Rotational setting information of the OPTTK is stored for additional projectiles in the same manner as described, but using the zero of the primary projectile.

Figure 6:
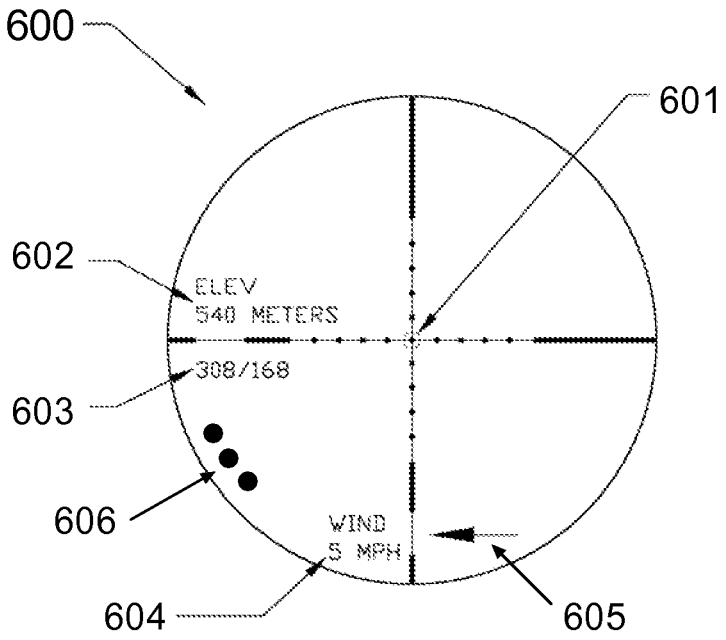
FIG. 6 depicts an exemplary field of view within a telescopic sight coupled to an OPTTK according to the subject matter disclosed herein.

In use, the operator determines a distance to a target, such as by estimation or by using a range finder. The OPTTK 100 is then rotated until the range is displayed in the field of view match the determined range to the target. FIG. 6 depicts an exemplary field of view 600 within a telescopic sight coupled to an OPTTK according to the subject matter disclosed herein. As the OPTTK is rotated, the corresponding range adjustment of the OPTTK along the stored trajectory profile is displayed at 602. For example, suppose that the operator programmed OPTTK rotational position settings corresponding to a zero at 100 meters and additional ranges at 200, 400, 600 and 1000 meters. In the field, the operator determines that the range to a target is 540 meters. The operator would then rotate the OPTTK to adjust the elevation setting of the telescopic sight and so that the elevation adjustment displayed at 602 matched the determined range of the target. As the OPTTK is rotated, the point of the stored trajectory profile that corresponds to the sensed rotational position of the OPTTK is output and displayed at 602. The same procedure for determining elevation settings and curve calculation can also be applied to the windage adjustment knob of an OPTTK system. In other words, the OPTTK can be used for elevation and windage adjustments. In another exemplary embodiment when the OPTTK for elevation is adjusted for a specific distance, an indication (not shown) for the proper parallax adjustment knob 105 is shown in the field of view 600.

In one exemplary embodiment, the OPTTK stores more than one trajectory profile and an identifier for the particular trajectory profile in use is displayed at 603. For example, the identifier for the particular trajectory profile depicted in FIG. 6 is for a 308 Winchester cartridge firing a projectile weighing 168 grains. In an alternative exemplary embodiment, a different type of trajectory profile could be used, such as, but not limited to, a number, a letter or an iconic shape. In another exemplary embodiment, other conditions sensed at the time that shot is taken, such as, but not limited to, projectile type, projectile velocity, slope (or inclination), temperature, altitude, and/or ambient weather conditions, could be displayed in the field of view. For example, the adjustment for wind speed could be displayed at 604 and the adjustment direction for wind direction could be displayed at 605. Alternatively, conditions at the time the trajectory profile was created could be displayed so that the operator can make appropriate adjustments in view of the current shooting conditions.

In one exemplary embodiment, the subject matter disclosed herein visually provides to an operator in the field of view of the telescopic sight a knob turns indicator 606 that indicates to the operator the number of complete rotational turns that has been imparted to the OPTTK. The electronic turns indicator can also be used on any conventional mechanical turret knob other than an OPTTK if equipped with an encoder and power source. In another exemplary embodiment, if the OPTTK is used during darkness or low lighting conditions, one or more of the reticle 601, the range indicator 602, the projectile indicator 603, other conditions indicators 604 and 605, and the knob turns indicator 606 could be illuminated in a well-known manner.

During use, the operator selects from the memory of the OPTTK the stored projectile trajectory that most closely matches the projectile in use. The operator uses a range finder or accurately estimates the distance to the target. In one exemplary embodiment, other additional information relating to the current conditions under which the shot is being taken, such as, but not limited to, cartridge, projectile type, projectile velocity, slope (or inclination), temperature, altitude, and ambient weather conditions can be made available to the electronic processing module of the OPTTK, such as by being manually entered by the operator, or by being coupled into the OPTTK in a well-known manner. The electronic processing module then determines corrections to the currently selected trajectory profile that compensate for the current conditions, and incorporates the corrections in the output provided to the operator, such as through the display in the field of view of the telescopic sight. The operator then rotates the OPTTK until the range/conditions displayed in the field of view match those measured, and takes the shot. For example, if an inclined shot is being taken, and the projectile trajectory being used was created based on level firing, the OPTTK determines the aiming corrections that should be made to the projectile trajectory being used for a proper point of impact, and automatically incorporates the corrections into the display presented to the operator so that the operator does not need to mentally compensate for the current shooting conditions.

Figure 7:
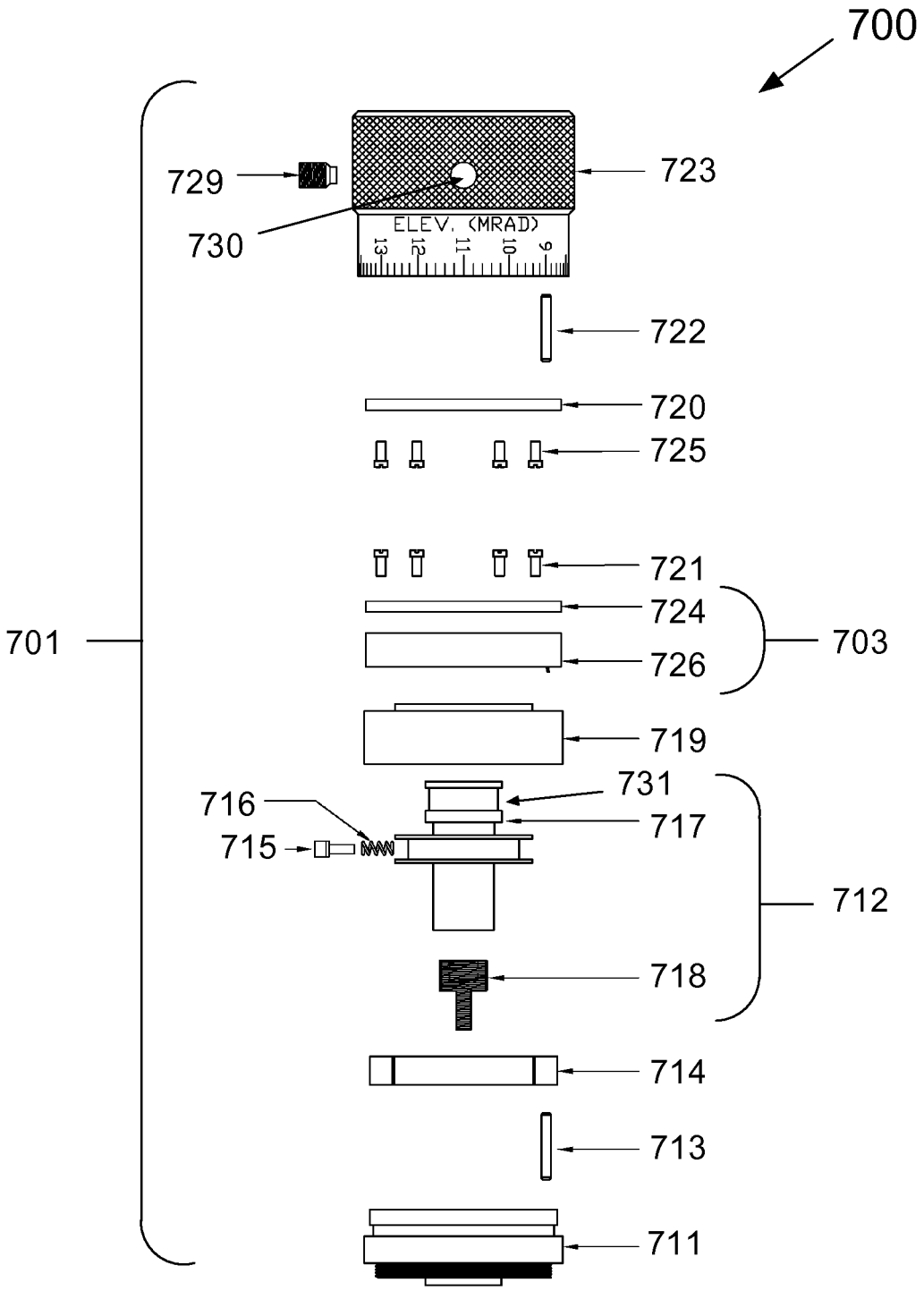
FIG. 7 depicts an exploded cross-sectional assembly view of a second exemplary embodiment of an OPTTK according to the subject matter disclosed herein.

FIG. 7 depicts an exploded cross-sectional assembly view of a second exemplary embodiment of OPTTK 700 according to the subject matter disclosed herein. As depicted in FIG. 7, OPTTK 700 comprises a turret knob section 701 and an electronic section 703. In contrast to the first exemplary embodiment depicted in FIGS. 1-4, the electronics section 703 of the second exemplary embodiment is generally located between turret knob section 701 and a telescopic sight (not depicted). Turret knob section 701 comprises a turret knob base 711, an adjustment spindle assembly 712, and a turret knob 723. Electronics section 103 comprises an electronic processor module 726 and battery or power source that is located remotely from OPTTK 700.

Turret knob base 711 is affixed in a fixed position to a scope body (not depicted in FIG. 7) in a well-known manner. A zero-stop pin 713 is inserted into a corresponding mating hole (not depicted) in turret knob base 711. A tactile ratchet gear 714 is installed on top of turret knob base 711 and aligned with the zero-stop pin 713. Tactile wedge pins (one or multiple dependent on design) 715, of which only one is depicted, and one or multiple wedge springs 716, of which only one is depicted, are inserted into mating holes (not depicted) in adjustment spindle 717. Tactile wedge pins 715 engage with splines (not depicted) formed internally to a tactile ratchet gear 714 and provide a tactile indication in a well-known manner as OPTTK 700 is rotated. A spade screw 718 is screwed into mating threads (not depicted) in the bottom of adjustment spindle 717. The assembled adjustment spindle 712 is inserted through a mating hole (not depicted) in the turret knob base 711 and is held to turret knob base 711 in a well-known manner by gear-retainer cap 719, an electronics processing module 726, an encoder sensor 724 and four cap-retaining screws 721.

A knob zero-stop pin 722 is inserted into a mating hole (not depicted) in a turret knob 723. A rotating encoder disc 720 is positioned at the bottom of or in a cavity (not depicted) in the bottom of turret 723 and held in place by four retainer screws 125. Rotating encoder disc 720 comprises encoded information that is sensed in a well-known manner by encoder sensor 724 for determining an angular position of turret knob 723 with respect to encoder sensor 724. Knob set screws 729, of which only one is depicted, are threaded into mating holes 730, of which only one is depicted, in turret knob 723. Turret knob 723 is then mated to adjustment spindle assembly 712 through a hole (not depicted) respectively formed in turret knob 723 and rotating encoder disc 720, and fixed in place by tightening knob set screws 729 against shoulder portion 731 of adjustment spindle 717.

Electronic processing module 726 is powered by a remotely located battery assembly (not depicted). In one exemplary embodiment, the remotely located battery assembly could be positioned in location 104 (FIGS. 1 and 2), remotely located to the telescopic sight, or along the body of the telescopic sight. Electronics processing module 726 is in electrical communication with encoder sensor 724 in a well-known manner, such as by, but not limited to, electrical conductors between electronics processing module 726 and encoder sensor 724. In another exemplary embodiment, the remotely located battery assembly could be positioned distal to the body of the telescopic sight, similar to the positioning of battery 127 in FIG. 1 for the first exemplary embodiment of the OPTTK.

Electronics processing module 726 is configured to process the output from encoder sensor 724 that indicates a rotational position of turret knob 723 with respect to rotating encoder disc 720 and communicate to a user the sensed rotational position of turret knob 723. FIG. 5 depicts a functional block diagram of one exemplary embodiment of electronics processing module 126. One exemplary embodiment of electronics processing module 726 could be configured similar to electronic processing module 126 depicted in FIG. 5.

Although the foregoing disclosed subject matter has been described in some detail for purposes of clarity of understanding, it will be apparent that certain changes and modifications may be practiced that are within the scope of the disclosed subject matter. Accordingly, the present embodiments are to be considered as illustrative and not restrictive, and the subject matter disclosed herein is not to be limited to the details given herein, but may be modified within the scope and equivalents of the disclosed subject matter.

What is claimed is:

1. A programmable telescopic sighting device having an adjustable reticle, the device comprising:

an optical adjustment member adjustably positionable about an axis of rotation, the adjustment member configured to move a reticle within a telescopic sighting device in proportion to the degree of rotation about the axis;

a sensor coupled to the adjustment member to sense a plurality of designated rotational positions of the adjustment member about the axis of rotation, each designated rotational position corresponding to the point of impact of a fired projectile on a target at a different remote distance, the sensor configured to output a signal corresponding to each sensed rotational position of the adjustment member at each designated rotational position;

a memory responsive to the output signals from the sensor and configured to store each designated rotational position of the adjustment member and the respective corresponding target distance;

a processor coupled to the sensor, the processor coded with instructions and configured to calculate a trajectory estimate through the plurality of designated rotational positions as a function of target distance, wherein the calculated trajectory estimate generally corresponds to the actual trajectory of a fired projectile and predicts a target distance for a given rotational position of the adjustment member; and further comprising a display coupled to the processor to visually depict the calculated target distance on the display corresponding to a selected rotation position setting of the adjustment member based on the calculated trajectory estimate.

2. The device according to claim 1, wherein the memory is further configured to store at least one of a type of projectile and a velocity of the projectile and an inclination of firing the projectile to a point-of-impact at a target distance of the fired projectile with respect to a level and a latitude and an ambient weather condition under which the projectile is fired.

3. The device according to claim 1, wherein the memory is further configured to store a specific calculated trajectory estimate for each of a plurality of different trajectory conditions.

4. The device according to claim 3, wherein the different trajectory conditions have a distinctive value based on at least one variable parameter selected from the group consisting essentially of: a cartridge firing a predetermined projectile, a type of the predetermined projectile, a velocity of the predetermined projectile, an inclination of firing the predetermined projectile with respect to a level reference, a temperature, an elevation, an ambient weather condition under which the predetermined projectile is fired, and a combination thereof.

5. The device according to claim 1, wherein the processor is further to calculate a target distance for a manually rotated position setting of the adjustment member about the axis of rotation.

6. The device according to claim 1, wherein the adjustment member is to adjust one of an optical elevation setting and an optical windage setting of an optical telescopic sighting device.

7. The device according to claim 1, wherein the calculated trajectory estimate comprises at least one of a best-fit curve and a piecewise linear determination and a solution of a series of polynomial equations.

8. A programmable turret knob for manually adjusting a reticle position within a telescopic sighting device as a calculated function of target distance, the turret knob comprising:

a manual adjustment member adjustably positionable about an axis of rotation, the adjustment member configured to move a reticle within a telescopic sighting device in proportion to the degree of rotation of the adjustment member about the axis;

a sensor coupled to the adjustment member to sense a plurality of discrete rotational positions of the adjustment member about the axis of rotation, each discrete rotational position of the adjustment member corresponding to the point of impact of a fired projectile on a target at a different remote distance, the sensor configured to output a signal corresponding to each sensed rotational position of the adjustment member at each discrete rotational position;

a memory to store each sensed discrete rotational position of the adjustment member and the respective corresponding target distance;

a processor coupled to the sensor, the processor coded with instructions and configured to calculate a trajectory estimate through the plurality of discrete rotational positions as a function of target distance, wherein the calculated trajectory estimate generally corresponds to the actual trajectory of a fired projectile and predicts a target distance for a given rotational position of the adjustment member; and further comprising a display coupled to the processor to visually depict the calculated target distance on the display corresponding to a selected rotation position setting of the adjustment member based on the calculated trajectory estimate.

9. The turret knob according to claim 8, wherein the memory is further configured to store a specific calculated trajectory estimate for each of a plurality of different trajectory conditions, and wherein the different trajectory conditions have a distinctive value based on at least one variable parameter selected from the group consisting essentially of: a cartridge firing the predetermined projectile, a type of predetermined projectile, a velocity of the predetermined projectile, an inclination of firing the predetermined projectile to a point-of-impact at a predetermined range with respect to a level reference, a temperature, a humidity, an elevation, or an ambient weather condition under which the predetermined projectile is fired, and a combination thereof.

10. The turret knob according to claim 8, wherein the calculated trajectory estimate comprises at least one of a best-fit curve and a piecewise linear determination and a solution of a series of polynomial equations.

11. The turret knob according to claim 8, wherein the manual adjustment member is to adjust one of an optical elevation setting and an optical horizontal setting of an optical telescopic sighting device.

12. A programmable turret knob for manually adjusting a reticle position within a telescopic sighting device as a calculated function of target distance, the turret knob comprising:

a manual adjustment member adjustably positionable about an axis of rotation the adjustment member configured to move a reticle within a telescopic sighting device in proportion to the degree of rotation about the axis, the manual adjustment member to adjust one of an optical elevation setting and an optical horizontal setting of an optical telescopic sighting device;

a sensor coupled to the adjustment member to sense a plurality of discrete rotational positions of the adjustment member about the axis of rotation, each discrete rotational position corresponding to the point of impact of a fired projectile on a target at a different remote distance, the sensor configured to output a signal corresponding to each sensed rotational position of the adjustment member at each discrete rotational position;

a memory to store each sensed discrete rotational position of the adjustment member and the respective corresponding target distance;

a processor coupled to the sensor, the processor coded with instructions and configured to calculate a trajectory estimate through the plurality of discrete rotational positions as a function of target distance, wherein the calculated trajectory estimate generally corresponds to the actual trajectory of a fired projectile and predicts a proper manually rotated position of the adjustment member for a given target distance, the calculated trajectory estimate comprising at least one of a best-fit curve and a piecewise linear determination and a solution of a series of polynomial equations; and a display coupled to the processor to visually depict the calculated target distance on the display corresponding to a selected rotation position setting of the adjustment member based on the trajectory estimate.

13. The turret knob according to claim 12, wherein the memory is further configured to store a specific calculated trajectory estimate for each of a plurality of different trajectory conditions, and wherein the different trajectory conditions have a distinctive value for at least one parameter selected from the group consisting essentially of: a cartridge firing the predetermined projectile, a type of predetermined projectile, a velocity of the predetermined projectile, an inclination of firing the predetermined projectile to a point-of-impact at a predetermined range of the predetermined projectile with respect to a level reference, a temperature, a humidity, an altitude, or an ambient weather condition under which the predetermined projectile is fired, and a combination thereof.

14. A programmable telescopic sighting device having an adjustable reticle, the device comprising:

an optical adjustment member adjustably positionable about an axis of rotation, the adjustment member configured to move a reticle within a telescopic sighting device in proportion to the degree of rotation about the axis;

a sensor coupled to the adjustment member to sense a plurality of designated rotational positions of the adjustment member about the axis of rotation, each designated rotational position corresponding to the point of impact of a fired projectile on a target at a different remote distance, the sensor configured to output a signal corresponding to each sensed rotational position of the adjustment member at each designated rotational position;

a memory responsive to the output signals from the sensor and configured to store each designated rotational position of the adjustment member and the respective corresponding target distance;

a processor coupled to the sensor, the processor coded with instructions and configured to calculate a trajectory estimate through the plurality of designated rotational positions as a function of target distance, wherein the calculated trajectory estimate generally corresponds to the actual trajectory of a fired projectile and predicts a target distance for a given rotational position of the adjustment member; and further comprising a display coupled to the processor to visually depict the current rotation position setting of the adjustment member about the axis of rotation.

15. A programmable turret knob for manually adjusting a reticle position within a telescopic sighting device as a calculated function of target distance, the turret knob comprising:

a manual adjustment member adjustably positionable about an axis of rotation, the adjustment member configured to move a reticle within a telescopic sighting device in proportion to the degree of rotation of the adjustment member about the axis;

a sensor coupled to the adjustment member to sense a plurality of discrete rotational positions of the adjustment member about the axis of rotation, each discrete rotational position of the adjustment member corresponding to the point of impact of a fired projectile on a target at a different remote distance, the sensor configured to output a signal corresponding to each sensed rotational position of the adjustment member at each discrete rotational position;

a memory to store each sensed discrete rotational position of the adjustment member and the respective corresponding target distance;

a processor coupled to the sensor, the processor coded with instructions and configured to calculate a trajectory estimate through the plurality of discrete rotational positions as a function of target distance, wherein the calculated trajectory estimate generally corresponds to the actual trajectory of a fired projectile and predicts a target distance for a given rotational position of the adjustment member; and further comprising a display coupled to the processor to visually depict the current rotation position setting of the adjustment member about the axis of rotation.

* * * * *